US005174050A

United States Patent [19]

Gabrielli

[11] Patent Number: 5,174,050

[45] Date of Patent: Dec. 29, 1992

[54] INNER LINING SHOE FOR BOOTS

[75] Inventor: Andrea Gabrielli, Predazzo, Italy

[73] Assignee: Calzaturificio Tecnica SpA, Treviso, Italy

[21] Appl. No.: 704,596

[22] Filed: May 23, 1991

[30] Foreign Application Priority Data

Jun. 5, 1990 [IT] Italy ..... 20546 A/90

[51] Int. Cl.[5] ..... A43B 5/04

[52] U.S. Cl. ..... 36/117; 36/10; 36/54; 36/55

[58] Field of Search ..... 36/10, 55, 54, 71, 117, 36/119, 93, 118, 120, 121

[56] References Cited

U.S. PATENT DOCUMENTS

| | | | |
|---|---|---|---|
| 1,707,129 | 3/1929 | McMurchy | 36/54 |
| 1,781,950 | 11/1930 | Hilgert | 36/54 |
| 2,887,795 | 5/1959 | Taicher | 36/54 |
| 2,915,837 | 12/1959 | Schlecht | 36/54 |
| 4,406,073 | 9/1983 | Spademan | 36/119 |
| 4,920,666 | 5/1990 | Marega | 36/54 |

FOREIGN PATENT DOCUMENTS

| | | | |
|---|---|---|---|
| 427321 | 5/1991 | European Pat. Off. . | |
| 3429284 | 2/1986 | Fed. Rep. of Germany . | |
| 654467 | 2/1986 | Switzerland . | |
| 673755 | 4/1990 | Switzerland . | |
| 677588 | 6/1991 | Switzerland . | |
| 336504 | 10/1930 | United Kingdom | 36/54 |

*Primary Examiner*—Paul T. Sewell
*Assistant Examiner*—Thomas P. Hilliard
*Attorney, Agent, or Firm*—Griffin, Butler, Whisenhunt & Kurtossy

[57] ABSTRACT

In an internal lining shoe (10) for boots, particularly ski boots, a fore tongue (15) is floatingly anchored to a vamp (11), in order to slide with respect to the vamp (11), through action of a resilient returning strip (19); the lining shoe structure being of a type not having excessively rigid areas reducing shoe comfort.

11 Claims, 4 Drawing Sheets

INNER LINING SHOE FOR BOOTS

BACKGROUND OF THE INVENTION

The present invention relates to internal lining shoes for boots, particularly ski boots.

It is well known that usually a ski boot comprises an external rigid shell, whose sole is anchored to a ski, an internal sole and an internal lining shoe completely enveloping a foot, preventing any direct contact between the foot, its ankle and the lower portion of its leg with the external rigid shell. This lining shoe is usually provided with a large fore tongue, movable with respect to remaining portions of the shoe, for allowing foot entering, in the same way as fore tongues of standard shoes. In operating terms, the lining shoe provided with the fore tongue must assure a tight connection between the user's foot and the external shell to faithfully transmit all controls which the foot intends to give to the ski.

The lining shoe must further assure excellent "comfort" both with respect to an easy fit and good adaptability to different positions and movements of the external shell and, more specifically, it should not apply local pressures on critical portions of the foot when the external shell is fastened.

To meet these requirements, a kind of lining shoe having a tongue integral with a fore portion of a vamp has been proposed, that lining shoe being the subject matter of European Patent Application No. 90 202 879.4 filed on Oct. 30, 1990 in the name of the present Applicant. Further, another kind of lining shoe having a tongue floatingly anchored to the vamp, i.e. with a possibility of relative resilient sliding with respect to the vamp, has been proposed. That kind of shoe is the subject matter of EP-A-0 317 798, filed on Oct. 31, 1988 in the name of the present Applicant, the description thereof being here referred to for a better knowledge of lining shoe structures.

The second mentioned shoe substantially meets the above indicated requirements, however an area in which the tongue is connected to the vamp is a critical area with enlarged thickness, where, in extreme cases, it is possible to have an excess pressure localized on a top, or back, of a foot as a consequence of external shell fastening. Further, the structure of that lining shoe appears to be rather complex with evident consequences on the manufacturing costs.

It is an object of the present invention to eliminate such a critical localized pressure area and simplify the shoe structure.

SUMMARY

Thus, according to principles of the present invention, an internal lining shoe for boots comprises a sole, a fore opened vamp with a tongue at the fore opening, and a leg portion completing the vamp, the tongue being floatingly connected to the vamp, i.e. with relative sliding freedom with respect to the vamp, with the tongue comprising at least a rigid external layer, wherein the external layer is connected to the vamp through a resilient member attached at one end portion to the rigid layer and at an other end portion to the vamp, with at least a continuous more internal and softer layer of the tongue continuously extending along the whole length of the tongue and the fore portion of the vamp.

Preferably, said resilient member consists of a resilient strip having a width less than that of the tongue, the resilient strip being connected to the rigid layer of the tongue by means of a flat headed pin and to the vamp by means of a seam extending along external edges of these members.

Preferably, said internal continuous layer has a variable thickness, with the thickness at the fore portion of the vamp being less than that at the tongue.

According to a further preferred embodiment, between the resilient strip and the most internal layer is interposed an intermediate plastic layer with at least a surface facing the resilient strip being smooth enough to allow a sliding of the resilient strip.

Preferably, the intermediate layer extends at least for the whole length of said resilient strip, has a width at least equal to that of the resilient strip, has a constant thickness which is less than that of the external layer of the tongue and is more flexible than the external layer of the tongue.

Preferably, the intermediate layer is connected to the external layer by means of a flat headed pin extending through a buttonhole having the same length as a stroke of sliding movement of the tongue and to a fore portion of the tongue by means of a seam.

BRIEF DESCRIPTION OF THE DRAWINGS

These and still other features, as well as relative advantages, will be more apparent from the following detailed but not limiting description referring to the enclosed drawing, in which.

DESCRIPTION OF THE PREFERRED EMBODIMENT

Figure 1:
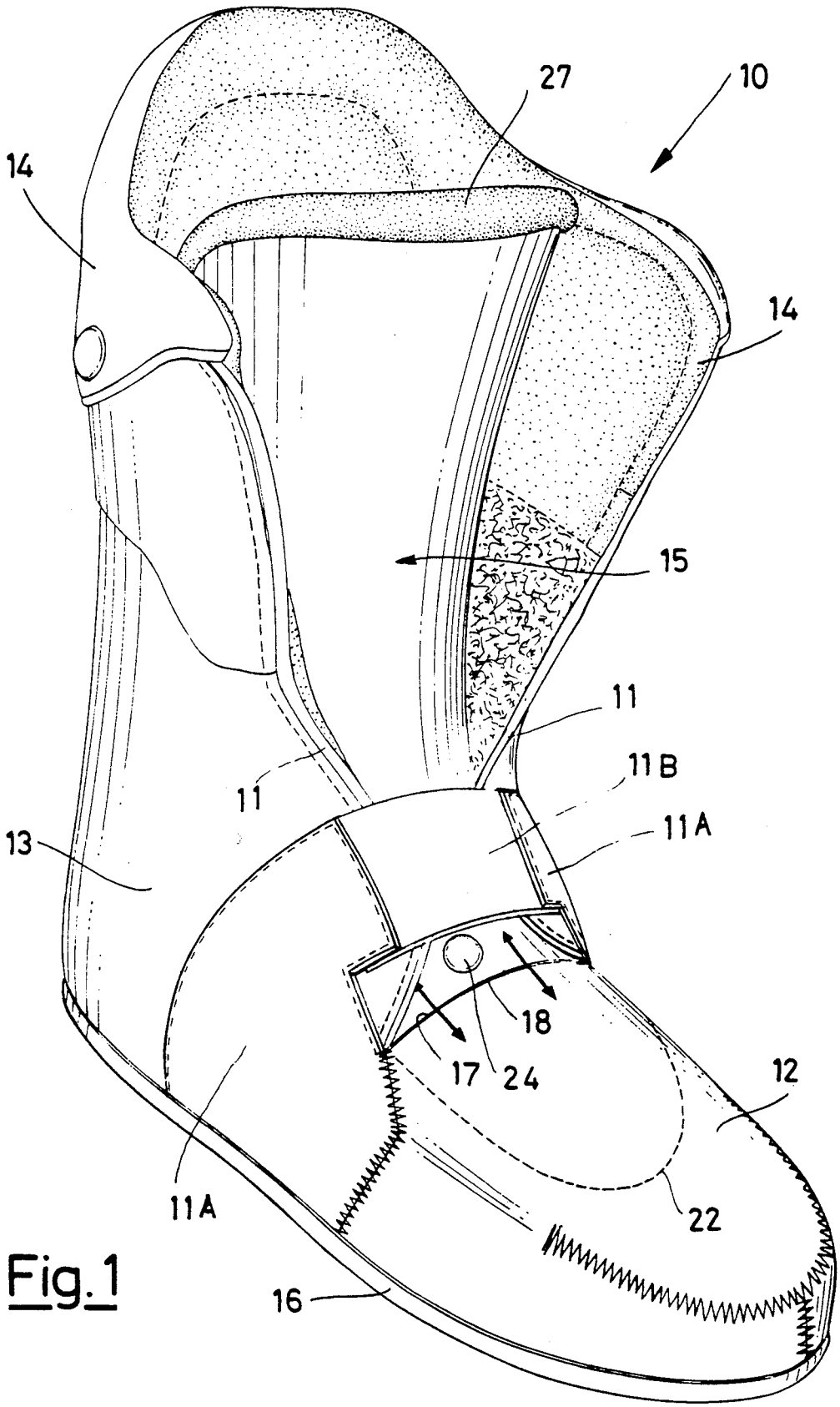
FIG. 1 is a perspective view of a lining shoe according to the present invention.

Referring to FIG. 1, a lining shoe 10 comprises a vamp 11, with a fore portion 12, an aft portion 13 and a leg portion 14, a tongue 15 and a sole 16.

The vamp 11 can comprise a pair of PVC bands 11A transversally connected to each other by a closing resilient web 11B.

Figure 2:
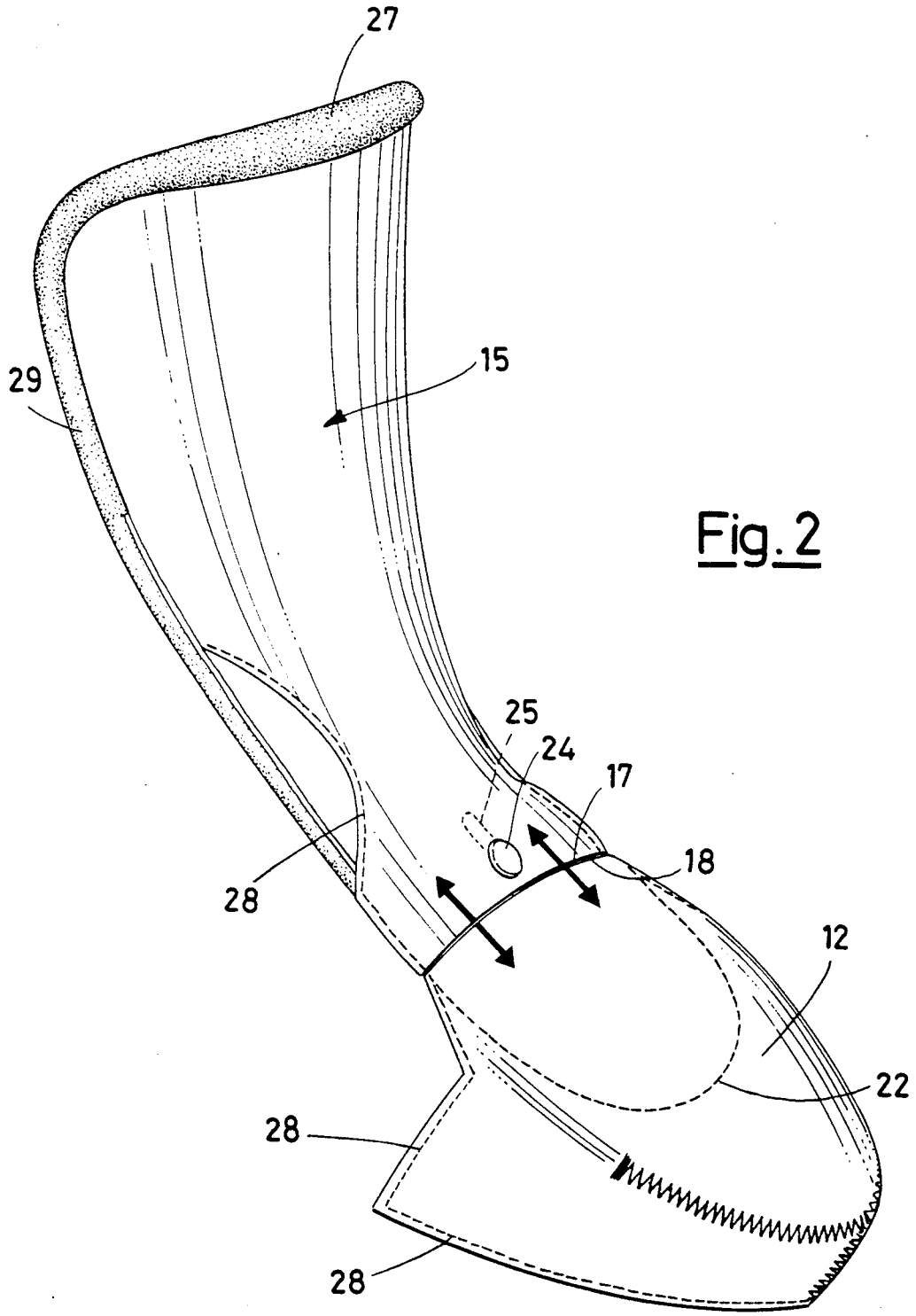
FIG. 2 is a perspective view of a tongue and fore portion of a vamp assembled in accordance with this invention.

The tongue 15 is arranged at a fore opening of the vamp 11 and the leg portion 14, closing the opening itself when the external shell of the boot (not depicted) is closed and fastened around the lining shoe. As shown in FIG. 2, the tongue 15 is connected with the fore portion 12 of the vamp and, as herebelow explained, it is possible to say that it forms an integral part of the vamp.

Figure 3:
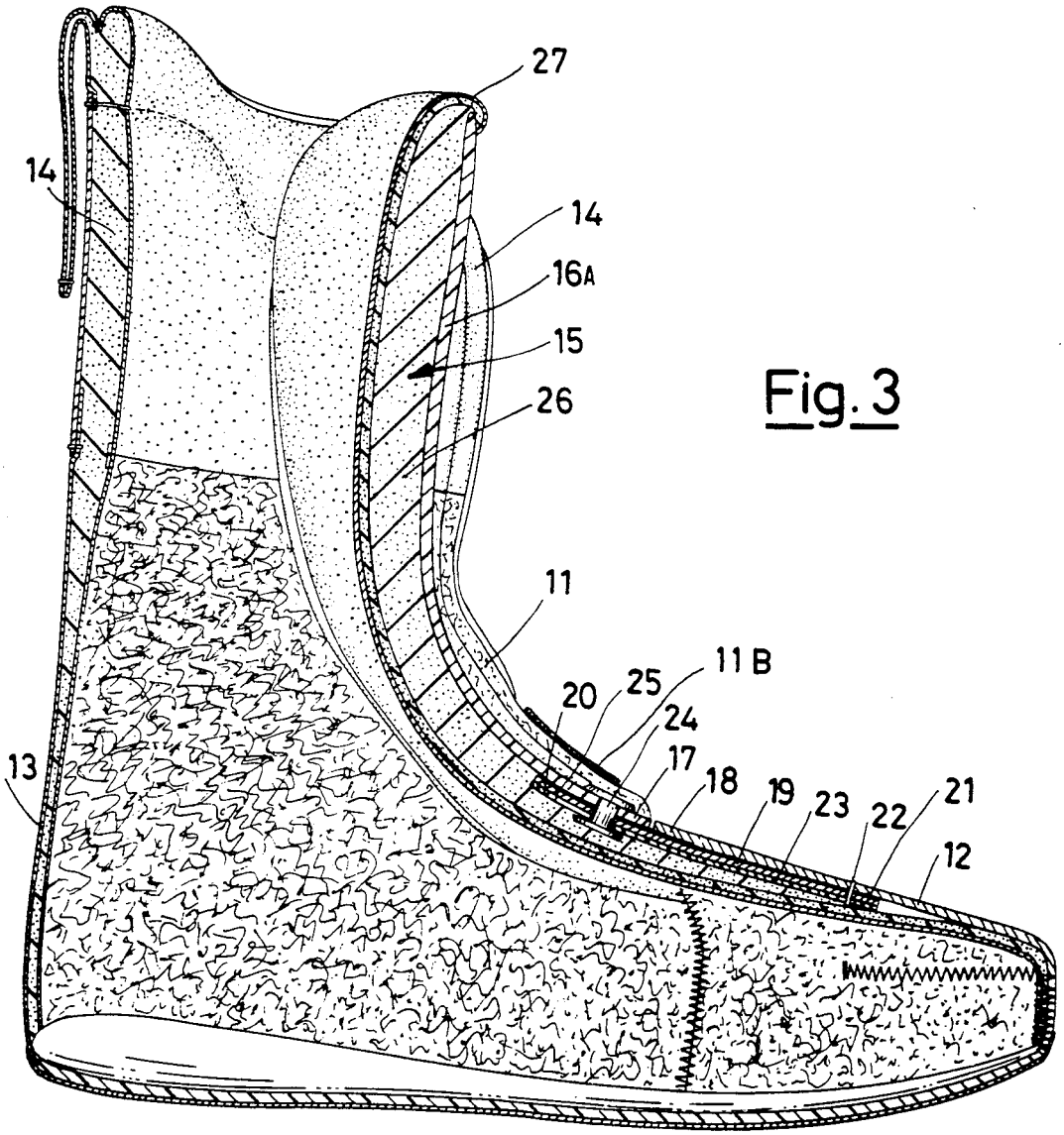
FIG. 3 is an elevation side view in cross-section of the lining shoe of FIG. 1.

FIG. 3 shows the structural members of the lining shoe and specifically the structure of the tongue 15 and the connection between it and the fore portion of the vamp 12.

The tongue 15 comprises an external layer **16*a*** of rigid plastic material (such a stiffness is higher than the vamp and namely could be of the same order of the external shell).

The vamp material, or better the most external layer thereof, could be an elastomer, for example neoprene rubber, supported by a square fabric. Said layer 16*a* extends from a highest portion of the tongue to a rounded region at the top, or back, of a foot, or also near the vamp, the end corresponding to this region, or area, being connected to an end 18 of the fore portion of the vamp 12 by means of an underlying resilient strip 19, which faces, or is flush with, and contacting both ends 17 and 18. The thicknesses of the two ends 17 and 18 are substantially equal, in order to avoid lack of uniformity which would reduce "comfort".

The resilient strip 19 has an end 20, extending beyond the end 17 of the layer 16*a*, to which it is connected by means of a flat headed pin or rivet 24. The opposite end 21 extending under the most external layer of the fore portion 12 of the vamp, is connected to the latter by means of a seam portion 22 (see also FIG. 2), with the resilient strip preferably having a lesser width than that of the tongue.

The resilient strip 19 rests against an intermediate plastic layer 23, which has an abutting surface smooth enough to allow a distortion sliding of the resilient strip, for example, when it is subjected to tensile stress. Said intermediate layer 23 extends at least for the whole length of the resilient strip 19, has a width at least equal to that of the resilient strip 19 and a constant thickness, namely of about 1 mm or less, in order to provide a substantially higher flexibility than the external layer of the tongue and substantially of the same order of that of the external layer of the vamp. It is important that the intermediate layer 23 not have substantially any influence on the flexibility of the vamp 12. The intermediate layer 23 is connected to the fore portion of the vamp by means of the seam 22, while it is anchored to the external layer of the tongue by means of the flat headed pin or rivet 24 passing through a buttonhole 25 having a length equal to a relative sliding stroke of the tongue, thereby resulting in controlled extension. The buttonhole width is substantially equal to the diameter of the main body of the pin 24, while the heads of the pin have a larger diameter to avoid the pin slipping from the buttonhole.

Under the intermediate layer 23, and beyond the extension area under the rigid layer 16*a* of the tongue, on one side, and under the most external layer 12 of the vamp on the other side, a continuous stuffing layer 26 is applied, which is, in turn, covered by a fabric lining on the whole surface directly contacting the foot. The lining can comprise a felt, a foamed elastomer and other similar material layer; a neoprene foamed "liner" associated with a fabric can coat the most internal portion of the stuffing (in the subsequent terminology "stuffing" or "stuffing layer" is intended to refer to any component thereof and in the specific case the "lining" is part of the stuffing). In any case, materials forming the stuffing must have some resilience, being able to absorb without tearing the relative sliding of the tongue with respect to the vamp.

The stuffing layer 26 extends without any interruption from the top 27 of the tongue to the tip of the lining shoe, lining the whole internal surface of the integrated member comprising tongue and fore portion of the vamp. The stuffing layer 26 is applied to the tongue and the fore portion of the vamp by means of a seam along edges 28 of the two components, interrupted at the ends 17 of the tongue and 18 of the vamp to allow the sliding relative to each other. At the top of the tongue and at at least part of the side edges thereof, the stuffing 26 can form a cuff 29 around the external most rigid layer.

Of course, the stuffing layer can also be applied by means of adhesives, or by means of a combination of seams and adhesives. As shown in FIG. 3, the thickness of the stuffing layer 26 is variable and tends to gradually decrease from the tongue to the fore portion 12 of the vamp; of course, the thickness is large enough to smooth any irregular or uneven feature due to overlapping of material layers arranged over the stuffing, specifically at the foot top, or back, portion, providing the "comfort" of the lining shoe when the boot shell is closed and fastened thereabout.

It can be seen from the above specification that the area about the ends 17 and 18 respectively of the tongue and the external layer of the vamp (which could be called a "critical area" for the "comfort" problem) has substantially constant and uniform thickness: which means that in spite of the "floating articulation" the path from the tongue to the vamp does not show substantial uneven/irregular features or steps. On the other hand, such a protruding unevenness is excluded by the presence of the resilient strip 19 and the intermediate layer 23, which are of thicknesses substantially uninfluential with respect to the thickness of the tongue and the vamp. Such an unevenness cannot substantially exist at the heads of the pin 24, since they are rounded and bevelled in order to distribute to as wide an area as possible any unevenness.

As a consequence, a structure according to this invention has a minimum of irregular/uneven features concentrated in a restricted and critical area: which is an important premise for reaching the highest possible "comfort". To achieve this result the internal stuffing is continuous from the tongue top to the vamp tip, not having any "unevenness"; on the other hand, the stuffing has adequate thicknesses to smooth any residual unevenness.

This invention provides a substantially improved comfort, with respect to that of known lining shoes of the prior art, through the assembly of simplified components with manufacturing cost benefits.

One cannot disregard the importance of the intermediate layer 23, which assures total sliding on its surface of the resilient strip 19. This means that the stretching and contracting of the resilient strip is not prevented by rough surfaces, as for example the surfaces of a stuffing material (as indicated in the state of the prior art); and through the structure of the present invention there is the highest comfort with the highest efficiency of controlled "floating sliding" between tongue and vamp.

Figure 4:
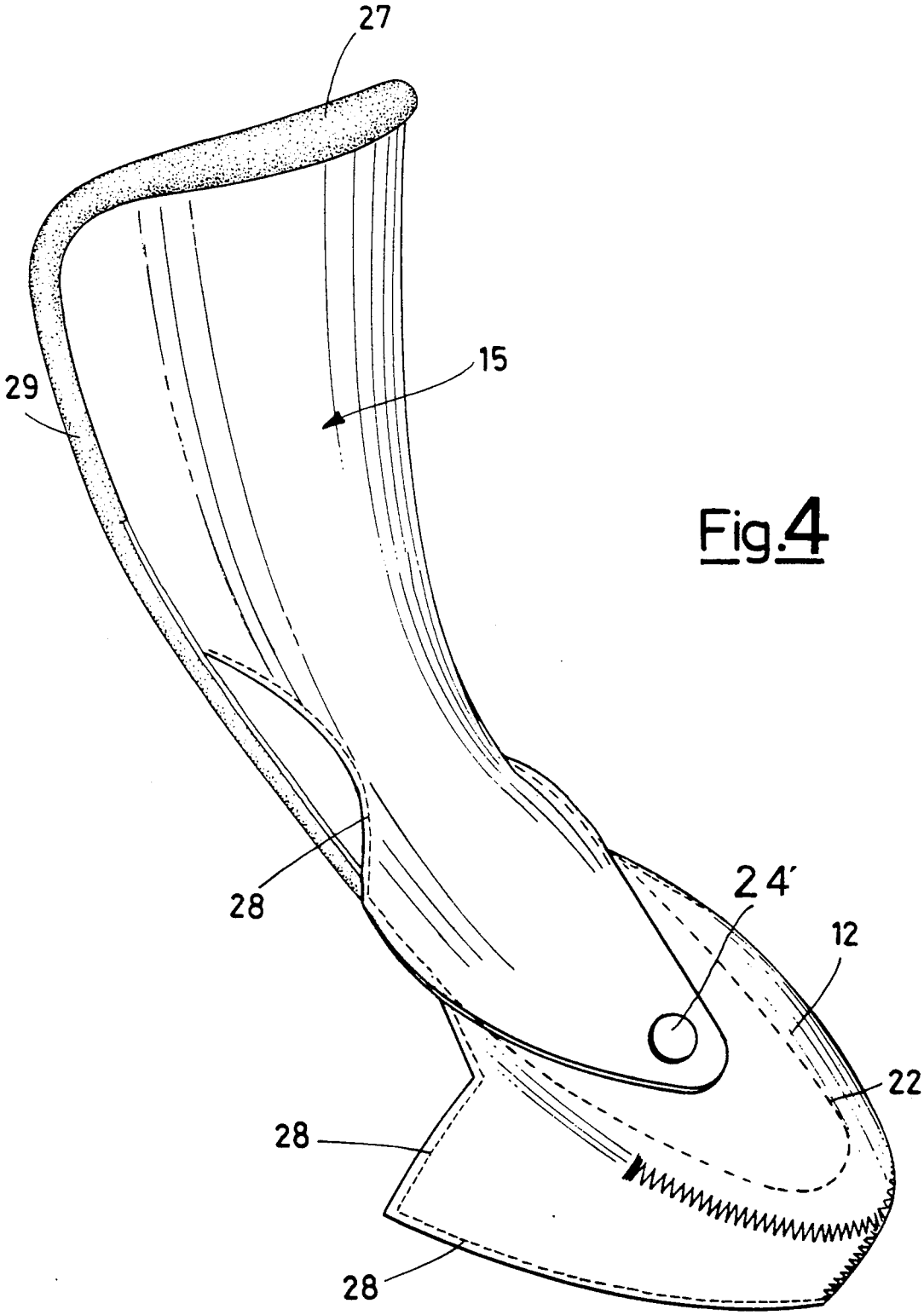
FIG. 4 is a view, similar to FIG. 2, of an embodiment variation of this invention showing a tongue and a fore portion of a vamp.

In FIG. 4 an embodiment variation is shown, in which parts similar or corresponding to those of FIG. 2 are indicated by the same reference numerals, but being different in their arrangement of the floating connection through a pin or rivet 24'.

While the lining shoe according to the present invention has been specified having reference to preferred embodiments thereof, it is intended that possible changes and variations thereof are within the scope of the present invention.

I claim:

1. Internal lining shoe for boots comprising a sole, a fore opened vamp and provided at said fore opening with a tongue thereof and a leg portion completing said vamp, said tongue being floatingly connected to said vamp to allow relative sliding freedom with respect to the vamp, said tongue comprising at least a rigid external layer, wherein said rigid external layer is connected to said vamp through a resilient means attached at a first end portion to said rigid external layer and at another end portion to said vamp with at least a continuous, more internal and softer layer, of said tongue continuously extending along the whole length of a fore portion of the vamp;

wherein said more internal and softer layer is connected to the tongue and the fore portion of the vamp by means of a seam extending along external edges of said more internal and softer layer.

2. Internal lining shoe, as in claim 1, wherein said resilient means comprises a resilient strip having a lesser width than the tongue.

3. Internal lining shoe, as in claim 1, wherein said resilient strip is connected to the rigid layer by means of a pin having flat heads.

4. Internal lining shoe, as in claim 1, wherein said more internal and softer layer has variable thickness, the thickness at the fore portion of the vamp being less than that at the tongue.

5. Internal lining shoe, as in claim 1, wherein said resilient means is a resilient strip and wherein between the resilient strip and the more internal and softer layer is interposed an intermediate plastic layer having at least a surface facing the resilient strip being smooth enough to allow sliding of said resilient strip.

6. Internal lining shoe, as in claim 4, wherein said intermediate layer has a constant thickness, less than that of the external layer of the tongue.

7. Internal lining shoe for boots comprising a sole, a fore opened vamp and provided at said fore opening with a tongue thereof and a leg portion completing said vamp, said tongue thereof and a leg portion completing said vamp, said tongue being floatingly connected to said vamp to allow relative sliding freedom with respect to the vamp, said tongue comprising art least a rigid external layer, wherein said rigid external layer is connected to said vamp through a resilient means attached at a first end portion to said rigid external layer and at another end portion to said vamp with at least a continuous, more internal and softer layer, of said tongue continuously extending along the whole length of a fore portion of the vamp;

wherein said resilient means is a resilient strip and wherein between the resilient strip and the more internal and softer layer is interposed an intermediate plastic layer having at least a surface facing the resilient strip being smooth enough to allow the sliding of said resilient strip;

wherein said intermediate layer extends at least along the whole length of said resilient strip.

8. Internal lining shoe for boots comprising a sole, a fore opened vamp and provided at said fore opening with a tongue thereof and a leg portion completing said vamp, said tongue being floatingly connected to said vamp to allow relative sliding freedom with respect to the vamp, said tongue comprising at least a rigid external layer, wherein said rigid external layer is connected to said vamp through a resilient means attached at a first end portion to said rigid external layer and at another end portion to said vamp with at least a continuous, more internal and softer layer, of said tongue continuously extending along the whole length of a fore portion of the vamp;

wherein said resilient means is a resilient strip and wherein between the resilient strip and the more internal and softer layer is interposed an intermediate plastic layer having at least a surface facing the resilient strip being smooth enough to allow the sliding of said resilient strip;

wherein said intermediate layer has a width at least equal to that of said resilient strip.

9. Internal lining shoe for boots comprising a sole, a fore opened vamp and provided at said fore opening with a tongue thereof and a leg portion completing said vamp, said tongue being floatingly connected to said vamp to allow relative sliding freedom with respect to the vamp, said tongue comprising at least a rigid external layer, wherein said rigid external layer is connected to said vamp through a resilient means attached at a first end portion to said rigid external layer and at another end portion to said vamp with at least a continuous, more internal and softer layer, of said tongue continuously extending along the whole length of a fore portion of the vamp;

wherein said resilient means is a resilient strip and wherein between the resilient strip and the more internal and softer layer is interposed an intermediate plastic layer having at least a surface facing the resilient strip being smooth enough to allow the sliding of said resilient strip;

wherein said intermediate layer is more flexible than the external layer of the tongue.

10. Internal lining shoe for boots comprising a sole, a fore opened vamp and provided at said fore opening with a tongue thereof and a leg portion completing said vamp, said tongue being floatingly connected to said vamp to allow relative sliding freedom with respect to the vamp, said tongue comprising at least a rigid external layer, wherein said rigid external layer is connected to said vamp through a resilient means attached at a first end portion to said rigid external layer and at another end portion to said vamp with at least a continuous, more internal and softer layer, of said tongue continuously extending along the whole length of a fore portion of the vamp;

wherein said resilient means is a resilient strip and wherein between the resilient strip and the more internal and softer layer is interposed an intermediate plastic layer having at least a surface facing the resilient strip being smooth enough to allow the sliding of said resilient strip;

wherein said intermediate layer is connected to the external layer of the tongue through a pin provided with flat heads extending through a buttonhole having a length equal to a relative sliding stroke of the tongue.

11. Internal lining shoe for boots comprising a sole, a fore opened vamp and provided at said fore opening with a tongue thereof and a leg portion completing said vamp, said tongue being floatingly connected to said vamp to allow relative sliding freedom with respect to the vamp, said tongue comprising at least a rigid external layer, wherein said rigid external layer is connected to said vamp through a resilient means attached at a first end portion to said rigid external layer and at another end portion to said vamp with at least a continuous, more internal and softer layer, of said tongue continuously extending along the whole length of a fore portion of the vamp;

wherein said resilient means is a resilient strip and wherein between the resilient strip and the more internal and softer layer is interposed an intermediate plastic layer having at least a surface facing the resilient strip being smooth enough to allow the sliding of said resilient strip;

wherein said intermediate layer is connected to the fore portion of the vamp by means of a seam.

* * * * *